United States Patent [19]

Kelley et al.

[11] 4,118,072

[45] Oct. 3, 1978

[54] VARIABLE WALL MINING MACHINE

[76] Inventors: Jay Hilary Kelley, 4204 Chestnut Hill, Morgantown, W. Va. 26505; Letcher T. White, 117 Wayne St., Manchester, Ky. 40962

[21] Appl. No.: 803,603

[22] Filed: Jun. 6, 1977

[51] Int. Cl.[2] ..... E21C 25/06; E21C 25/68

[52] U.S. Cl. ..... 299/43; 299/31; 299/33; 299/87

[58] Field of Search ..... 299/18, 31-34, 299/43-48, 87

[56] References Cited

U.S. PATENT DOCUMENTS

| | | | |
|---|---|---|---|
| 3,309,880 | 3/1967 | Potts et al. | 299/32 X |
| 3,445,139 | 3/1969 | Von Hippel | 299/87 X |
| 3,524,680 | 8/1970 | White | 299/31 |
| 3,640,580 | 2/1972 | White | 299/31 |
| 3,650,123 | 3/1972 | Sheppard, Jr. | 64/17.5 P |

*Primary Examiner*—Stephen J. Novosad
*Assistant Examiner*—Nick A. Nichols, Jr.
*Attorney, Agent, or Firm*—Thomas H. Murray

[57] ABSTRACT

A variable wall mining machine to release coal from a longwall mine face includes an articulated auger assembly made up of a plurality of side-cutting auger sections joined together by universal couplings in an end-to-end relation and coupled to a drive at one end of the assembly. A scavenger plow, supported on the mine floor, consists of sections connected together for articulated movement toward and away from the longwall mine face. Two support arms are journaled by bearings to each auger section and the other ends of the arms are pivotally supported by one of the scavenger power sections. Hydraulic actuators, supported by mine roof supports, move two adjacent scavenger plow sections together with two auger sections as a pair into sumping cuts with the longwall mine face. Other hydraulic actuators supported by the scavenger plow control the elevation of the pivotal arms and, hence, the auger assembly coupled thereto for shear cutting the mine face. A sequentially-operated control is provided for advancing the auger sections in pairs for sumping cuts in a sequential manner along the length of the articulated auger assembly. The control means further includes a controller for the hydraulic actuators to lift the auger sections in pairs for sequential shear cuts.

19 Claims, 7 Drawing Figures

VARIABLE WALL MINING MACHINE

BACKGROUND OF THE INVENTION

This invention relates to a variable wall mining machine to not only release coal from the face of a longwall mine, but also to transport the coal released from the mine face without the need for auxiliary conveying equipment at the longwall mine face. More particularly, the present invention relates to such a variable wall mining machine including side-cutting auger sections joined together in an end-to-end relation by universal joints for sumping movements in pairs in a progressive manner commencing from one end of the auger assembly to the other end and followed thereafter by movements of the auger sections in pairs for shear cutting the mine face in the same progressive displacement manner as provided for sumping cuts.

As is known in the art, a cutting device, such as a scroll or auger with bits mounted thereon, is a feasible device for releasing coal from a longwall mine face. The scroll or auger is rotated so that the bits dig into the coal face to release the coal therefrom. At the same time, the scroll or auger provides a mechanism by which the coal may be transported away from the site of the mine face. Such a device, for example, is shown in U.S. Pat. Nos. 3,524,680 and 3,640,580. The mining machine disclosed in these patents includes the use of a plurality of axially-aligned augers which are connected together by a sleeve and driven from opposite ends. The helical edges of the auger are provided with hardened cutting points to release coal from the coal vein. Pressure is applied to the augers laterally thereof at spaced points to gradually move the entire string of augers as a whole into the vein of coal and effect cutting thereof. A scavenger board is carried at the side of the augers opposite the vein of coal. A device of this type for releasing coal from a mine face differs from the conventional auger-type miner in that the cutting is effected at the circumference of the auger rather than head-on. Transportation of the coal released during the mining operation is carried out by the auger as in conventional auger-type mining. In this type of auger mining machine, the string of augers is fed into an exposed highwall of a coal face for a distance up to, for example, 200 feet and, in some cases, even 300 feet and provides very high productivity. However, a mining machine of this type is inefficient in terms of kilowatt hours per ton of coal released from the mine face in light of the depth of penetration per bit. Generally, the linear speed of the cutting bits was high but the penetration per bit was low. The speed at which an auger having a given design can be rotated is a function of the rate at which coal is released from the mine face and the rate at which the released coal can be transported by the auger. Increasing the speed of the auger enables a more rapid transportation of the coal; however the higher linear speed of the bit across the coal face brings about a demand for increased horsepower with little increase in production. Tests have shown that increasing the auger speed of rotation by 20 revolutions per minute, for example, will yield about the same coal output per kilowatt hour while significantly decreasing the service life of the cutting bits.

The use of an auger with cutting bits on the side edge thereof provides a highly desirable form of mining machine; however the known arrangement of parts to effect the release of coal has certain acute disadvantages which the present invention is designed to overcome.

Specifically, for example, when the auger which may have a string length of as much as 500 feet is moved into contact with the mine face along the entire length thereof, the power requirements become excessively large. The need to uniformly advance the auger along its entire length into the mine face cannot be accomplished within acceptable limits, thus damaging forces are imposed on the torque-transmitting shaft component of the auger causing the joints between the auger segments to break as well as the auger shaft itself. Increasing the shaft size to meet the torque requirements significantly reduces the conveying capacity of the auger itself, and thus is not an acceptable solution. Also the physical size of a motor to drive a full sumping machine could not be brought into a mine let alone suitably housed in a mine section. Moreover, the power supply to the motor would be difficult to install and maintain.

SUMMARY OF THE INVENTION

It is an object of the present invention to provide an improved mining machine for releasing coal from a longwall mine face through the use of a side-cutting articulated auger assembly including auger sections joined in an end-to-end relation by universal couplings for progressive advancing movement into the mine face in a successive manner from one end of the articulated auger assembly to the other.

It is another object of the present invention to provide an improved construction and arrangement of parts for providing and controlling hydraulic actuators to advance a side-cutting articulated auger assembly in a progressive manner by moving auger segments joined together by universal couplings in pairs into the mine face for sumping cuts and thereafter for shear cuts.

It is still another object of the present invention to provide an improved support arrangement for individual sections of a side-cutting articulated auger assembly through the use of a floor-supported scavenger plow made up of sections that are connected together for an articulated movement while pivotally supporting an end of support arms that are joined with bearings to journals provided on each shaft segment in the articulated auger assembly.

In accordance with the present invention, there is provided a variable wall mining machine to release coal from a longwall mine face comprising a plurality of side-cutting auger sections to release and convey coal along a mine face, universal coupling means joining the auger sections together in an end-to-end relation to form a side-cutting articulated auger assembly extending along the longwall mine face, drive means coupled to at least one auger section to rotate the auger assembly, actuator means for individual ones of the plurality of side-cutter auger sections to sump and shear cut the mine face, sequentially operative control means for the actuator means to advance the cutting auger sections sequentially into sumping cuts in the mine face, and scavenger plow means spaced outwardly in a partially surrounding relation with the articulated auger assembly at the side thereof opposite the mine face to facilitate transportation of material released from the mine face by the side-cutting articulated auger assembly.

The aforementioned side-cutting auger sections preferably include a drive shaft having an auger with cutting elements at spaced points about the outer edge thereof. Preferably, two bearings are journaled near the ends of an individual auger section for support thereof by pivot arms that are carried at their opposite ends by the scavenger plow. The scavenger plow preferably includes a plurality of elongated support frames joined together end-to-end by pivot members to form an articulated scavenger plow assembly. Each of the support frames includes a shoe plate to engage the floor at the longwall mine face and a guide plate extending upwardly from the shoe plate in an arcuate manner to retain the coal released from the mine face within the open spaces in the auger assembly for transportation thereby. At least some of the support frames support hydraulic actuators to position the pivot arms carrying the auger assembly for shear cutting the mine face; while separate hydraulic actuators supported by mine roof supports or the like sequentially advance the support frames toward the mine face for sumping cuts.

In the preferred form of the present invention, the aforementioned sequentially-operative control means energizes the actuator means for sumping cuts by two adjoined auger sections in a manner such that successive pairs of these auger sections are advanced for sumping cuts at closely spaced intervals of time along the entire length of the articulated auger assembly. This achieves an economically feasible ratio between horsepower requirements and stress requirements for the articulated auger assembly. A shield member is supported by the scavenger plow means to extend vertically toward the roof of the longwall mine while supported for pivotal movement to retract the shield for servicing operations.

These features and advantages of the present invention as well as others will be more fully understood when the following description is read in light of the accompanying drawings, in which.

Figure 1:
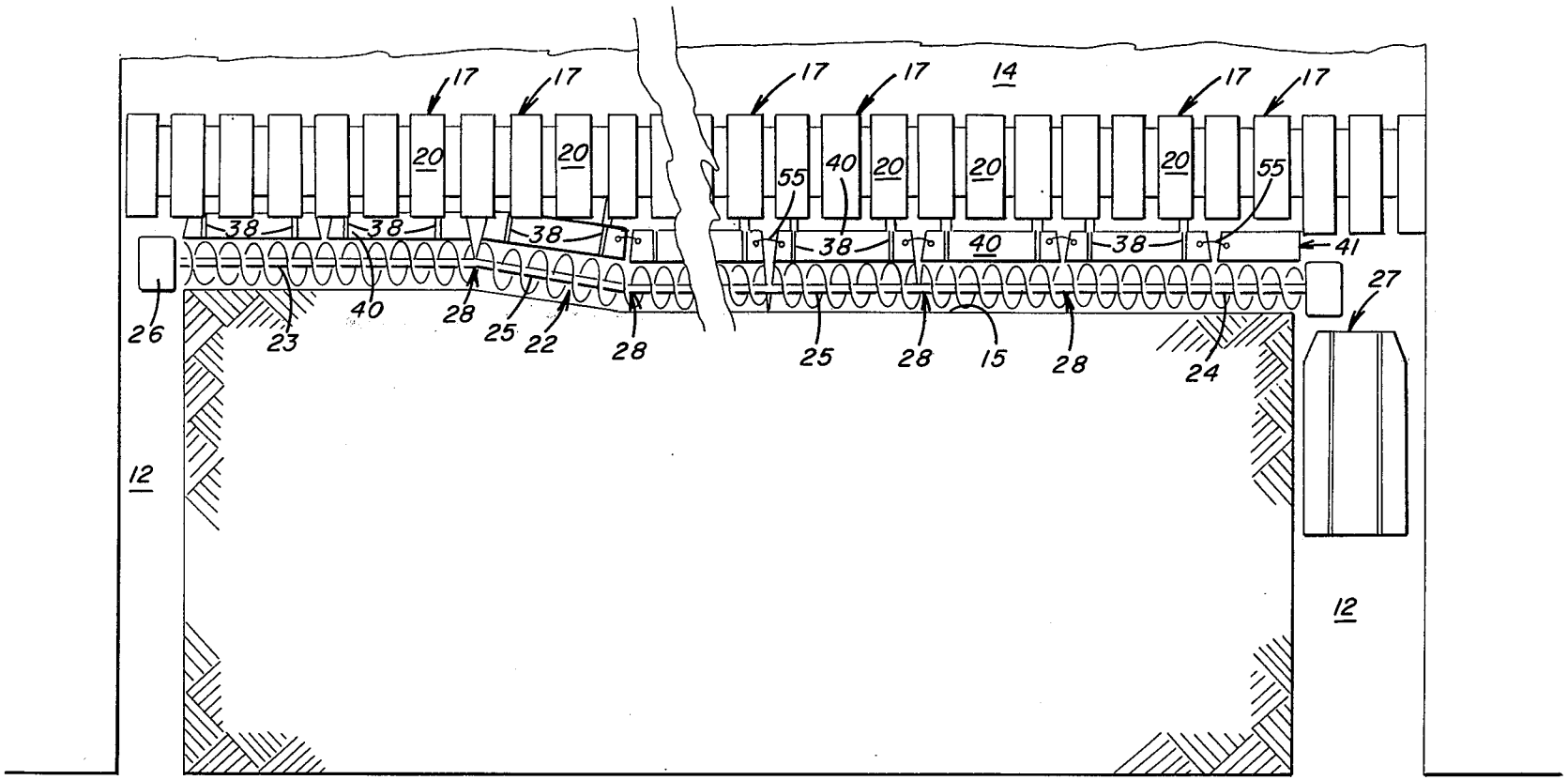
FIG. 1 is a plan view of a portion of a mine layout showing the position of the variable wall mining machine to release coal from the longwall mine face.

In FIG. 1, the main gallery 10 of a coal mine is shown. Laterals 12 extend from the gallery at different locations such as, for example, at a spacing of 500 feet. The laterals 12 are interconnected at their distal ends by a tunnel 14 having a side wall that defines a longwall mine face 15. The laterals are typically formed by a continuous miner along a track of 3000 feet or more. The variable wall mining machine of the present invention is employed to release coal from the longwall mine face 15. During the coal releasing operation, the roof in tunnel 14 is supported by conventional roof supports 17. The roof supports are arranged at closely-spaced intervals along the entire length of the longwall mine face in parallel relation therewith. Each roof support includes a hydraulic jack having a piston 19 connected to a load-bearing support platen 20.

As shown in FIG. 1, the variable wall mining machine of the present invention includes an articulated side-cutting auger assembly 22 made up of a string of auger sections, for example, each 12 feet long. The auger sections are arranged end-to-end to extend along the entire length of the longwall mine face. The drive end auger section 23 and the discharge end auger section 24 are constructed in substantially the same manner as the intermediate auger sections 25 except that their terminal ends are adapted to a drive and a conveyor. In the case of drive section 23, it is coupled to a drive motor 26 while the terminal end of discharge auger section 24 cooperates with coal transport means 27 such as a shuttle transfer car or conveyor. The individual auger sections are coupled together in an end-to-end relation by universal joints 28 to form the articulated sidecutting auger assembly 22.

Figure 3:
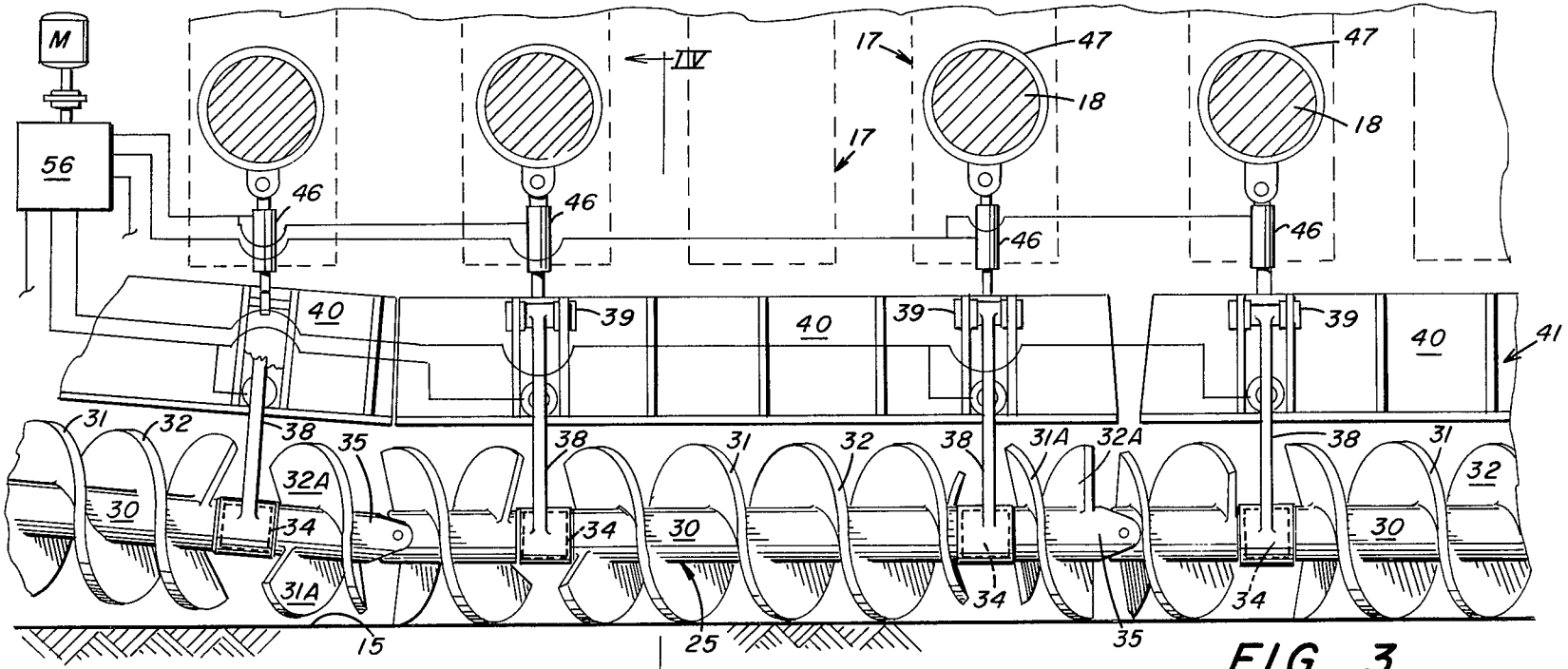
FIG. 3 is an enlarged plan view of the variable wall mining machine shown in FIG. 1.
Figure 2:
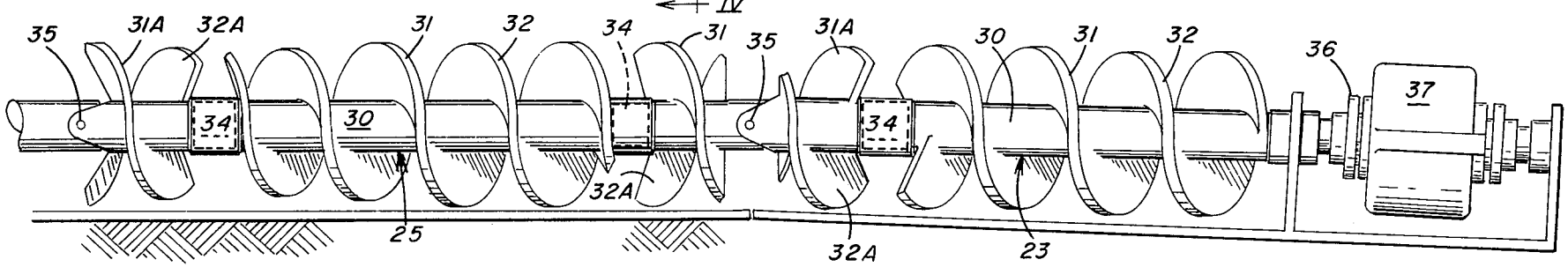
FIG. 2 is an enlarged elevational view of the articulated auger assembly embodying the features of the present invention.
Figure 2A:
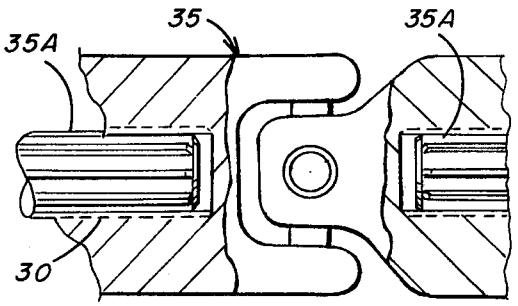
FIG. 2A is an enlarged view, in section, of a universal coupling for joining together auger sections.
Figure 4:
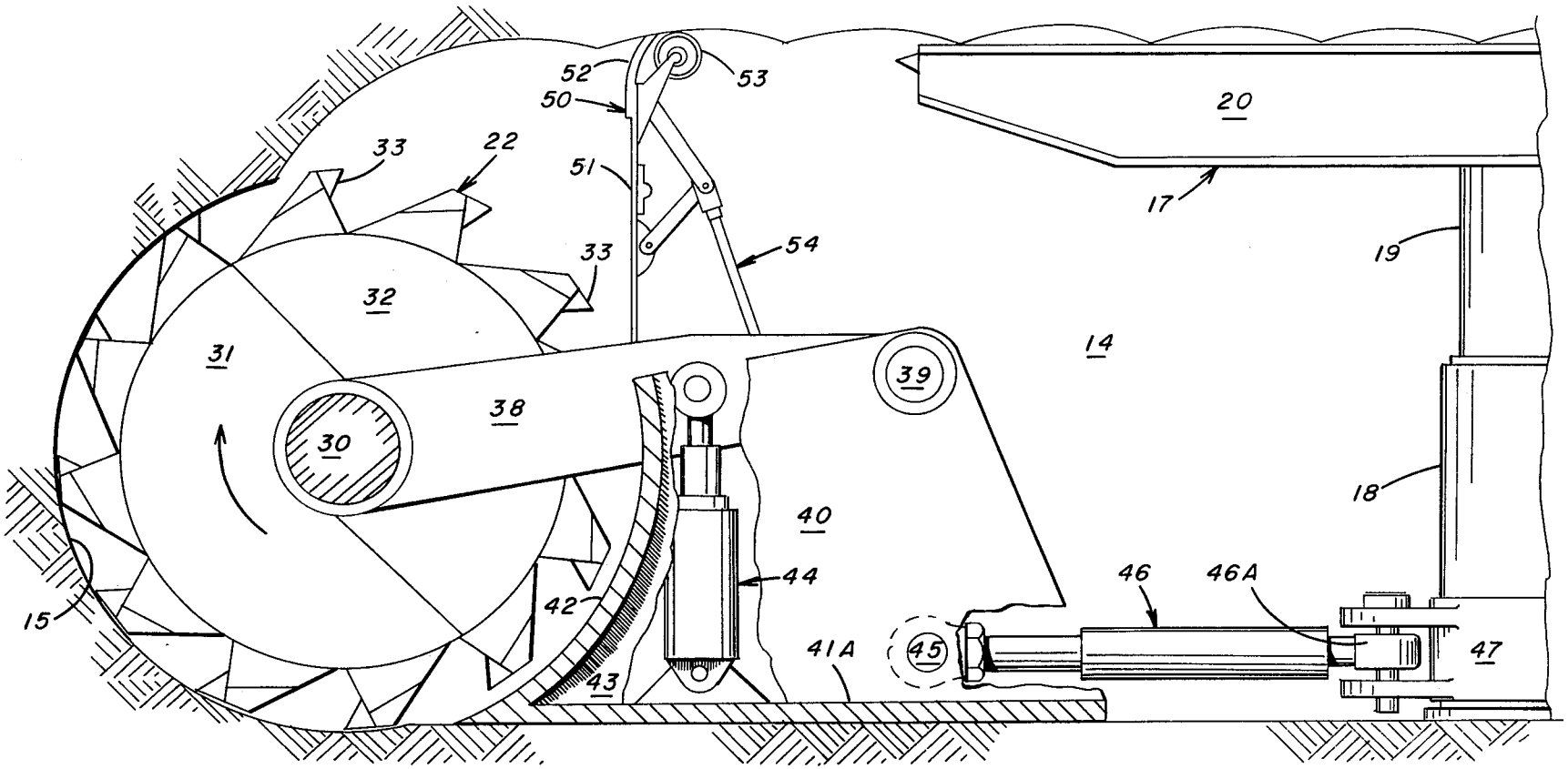
FIG. 4 is a sectional view taken along line IV—IV of FIG. 3.

More specifically, as shown in greater detail in FIGS. 2–4, each side-cutting auger section in the articulated side-cutting auger assembly includes an auger shaft 30 supporting two helix blades 31 and 32 arranged to form spirally-shaped augers, each having an outer peripheral edge surface onto which there is secured cutting elements 33. Each side-cutting auger section further includes two bearing journals 34 spaced a short distance inwardly from the terminal end of the auger section. As shown in FIG. 2A, one-half of the universal coupling 35 is slidably received upon a splined end 35A of each auger section. The splined interconnection between the ends of auger shaft 30 accommodates a slight separation between the ends of the shafts when they are moved in a sequential manner. When the auger sections are 12 feet long, the axial separation contemplated is about 0.8 inch with a maximum misalignment angle between auger shafts of 5.9°. Gear-type couplings may be employed to form the universal coupling and thereby avoiding the need to employ the splines. As shown in FIGS. 2 and 3, the space between the journals 34 and the half of the coupling 35 at each end of the auger sections 25 form a short shaft segment onto which there is provided two helically-shaped blades 31A and 32A.

The blades 31A and 32A extend beyond the terminal end of the shaft to partially overlie the universal coupling 35. As pointed out previously, the auger sections are connected together in an end-to-end relation to form an articulated auger assembly which includes the drive end auger section 23 which is coupled at its free end by a coupling 36 to the drive output shaft of a gear drive 37. The gear drive is, in turn, driven by an electrical motor or other means. For each auger section, two support arms 38 are attached at one of their ends by a sleeve-type or anti-friction type bearing to the journals 34. The arms 38 extend toward the mine roof supports 17 where their projected ends are attached by pivot shafts 39 to a scavenger plow section 40 which forms part of an articulated scavenger plow assembly 41 extending along a spaced-apart, parallel relation with the articulated auger assembly 22.

The articulated scavenger plow assembly is located at the side of the auger assembly opposite the longwall mine face. The scavenger plow assembly includes a bottom plate 41A forming a support surface to rest upon the mine floor. Extending in an arcuate upward manner from the bottom plate 41A is a curved guide plate 42 to guide and maintain the coal released from the longwall mine face within the spaces between the spirally-shaped convolutions of the auger blades. The guide plate 42 is supported by vertically extending gussets 43 at spaced-apart locations along each scavenger plow section. These gussets are provided with annular openings at their upper ends to support the pivot shafts 39. Fluid actuators 44, in the form of piston and cylinder assemblies, are supported by clevis mountings upon the bottom plates 41A and secured at their rod ends to the arms 38. The hydraulic actuators 44 are employed to pivotally displace the support arms 38 in an upwardly-arcuate manner so as to raise the cutting augers for shear cutting the longwall mine face. Such shear cutting is performed after sumping cuts are made into the longwall mine face in a manner now to be described. The gussets are provided with openings into which pins 45 are employed to secure the rod ends of piston and cylinder assemblies 46 that form hydraulic actuators that are supported at their cylinder ends by the mine roof supports.

The hydraulic actuators 46 each includes a clevis plate 46A that is secured to a mounting bracket 47 which is, in turn, secured to the cylinder 18 of a mine roof support 17. On the top surface of the scavenger plow assembly, there is supported a retractable shield 50. This shield includes a plate 51 carrying along its upper edge a flexible strip 52 behind which there is also provided a plurality of axially aligned rollers 53 adapted to engage and ride along the roof surface of the mine. The retractable shield is lowered for servicing by a hydraulic actuator 54 supported by each of the scavenger plow segments.

The articulated scavenger plow assembly 40, as described previously, is made up of individual scavenger plow sections which are secured together by links 55 (FIG. 1) so that the individual scavenger plow sections can be moved along the mine floor relative to each other. The side walls between adjacent plow sections diverge in an outward direction from the mine face so that the space between the plow sections progressively increases outwardly from the mine face. Movement of the scavenger plow assembly is accomplished by energizing the hydraulic actuators 46. In accordance with the preferred aspect of the present invention, the cutting auger assembly is advanced into the longwall mine face in a successive manner by energizing the hydraulic actuators 46 through a sequentially-operative control valve assembly 56. Cutting auger sections, more specifically the end portions of two cutting auger sections joined together by a universal coupling, are simultaneously moved into the longwall mine face. Thus, for example, the first cutting auger sections to be advanced into the longwall mine face will consist of the cutting auger section 23 and the cutting auger section 22 coupled thereto by a universal coupling. More specifically, this is accomplished by initially actuating only the piston and cylinder assemblies 46 joined to the scavenger plow sections in close proximity to support arms 38 joined to auger sections 23 or 22 adjacent the universal joint therebetween. After these two cutting auger sections have been advanced to the desired extent into the longwall mine face, the sequentially operative control valve assembly 56 energizes the next two piston and cylinder assemblies 46 to thereby advance the end portions of cutting auger sections 22 joined together by a universal joint in the string into the longwall mine face which is succeeded again by advancing the next two adjacent ends of cutting auger sections 22, etc. In other words, the coupled portions of auger section pairs are advanced sequentially. This movement of the articulated auger assembly proceeds by successively straightening the auger sections into the mine face. After the entire articulated auger cutting assembly 20 has been moved by sumping cuts in this manner into the longwall mine face, the hydraulic actuators 44 are controlled by the sequentially operative control valve assembly 56 in a similar manner to that as just described for the sumping cuts, namely, the end of cutting auger 23 and the end of the adjacent auger section 22 coupled thereto by the universal coupling are raised to the mine roof for shear cutting the longwall mine face. After these ends of auger sections complete the shear cutting operation, the next succeeding ends between two auger sections 22 are raised by energizing the corresponding hydraulic actuators 44 which are, in turn, followed by raising the end of the next succeeding pair of cutting auger sections, etc. Alternatively, the shearing operation can begin before the end of the sumping cut by the entire string of augers, thereby augmenting the production rate and loading on the transport function of the auger string. In contradistinction from the sumping sequence, the consecutive pairs of auger sections are immediately lowered to the floor in order to allow the auger transport function to resume. It should be observed that raising the auger sections in the shearing mode partially interrupts the transport function of the augers. At the end of the shearing operation, the mine roof supports are then advanced if necessary or desirable which is then followed by sumping cuts by the auger sections in the manner just described. In one form, the sequentially operative control valve assembly 56 includes a plurality of spaced-apart cams secured onto a motor-driven shaft to actuate in succession the valve stems of hydraulic control valves which are coupled in separate fluid supply lines for the individual actuators.

In another form, the successive pairs of control valves are pilot-operated from the previous pair after the latter has reached its limit of travel. This can be accomplished by an operating pressure increase and by a mechanically operated pilot valve.

In a third, but not final form, the sumping and shearing operations can be programmed by an electronically or electromechanically control system which activates the hydraulic control valves, hydraulic pilot valves or remotely located solenoid valves.

Figure 5:
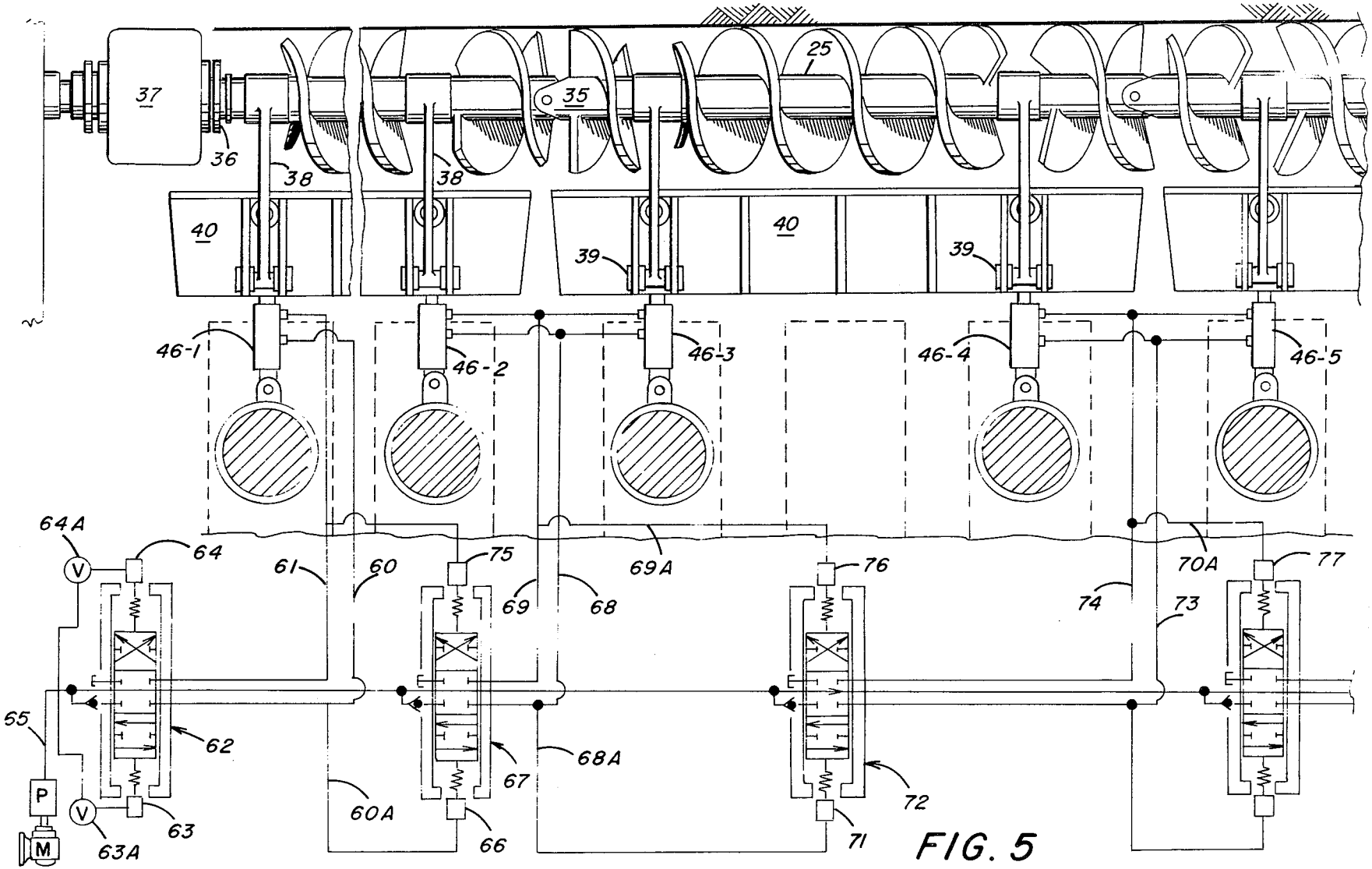
FIG. 5 is an enlarged plan view similar to FIG. 3 but illustrating a modified control for the hydraulic actuators for the articulated auger assembly.

FIG. 5 illustrates a modified hydraulic control arrangement for the sequential sumping movements of the auger sections. The same form of hydraulic control is used for sequential shear-cutting movements of the articulated auger assembly of the present invention. In FIG. 5, the parts forming the articulated auger assembly including the scavenger plow assembly bear the same reference numerals since they are the same as already described in regard to FIGS. 1–4. However, a preferred form of control system is shown in FIG. 5 for various sumping cylinders which have been more specifically identified as 46-1, 46-2, 46-3, 46-4 and 46-5 in relation to the side-cutting auger sections. It is to be understood that the control system is extended to accommodate the actual number of hydraulic sumping cylinders. The cylinder end and the rod end of piston and cylinder assembly 46-1 are connected by lines 60 and 61, respectively, to a hydraulic valve 62. A movable spool forming part of the valve 62 is controlled by pilot-pressure actuators 62A and 62B. These actuators are coupled by springs to opposite sides of the movable spool which is normally in a central blocking position with respect to a source of hydraulic pressure in line 65 provided by a motor-driven pump. Control valves 63A and 64A are used at different times to direct hydraulic fluid from line 65 to the pilot-pressure actuators 63 and 64, respectively. Let it be assumed that valve 63A is energized to thereby activate the pilot-pressure actuator 63 which, in turn, shifts the pool so that the pressure in line 65 is delivered through a check valve into line 61. The hydraulic fluid is delivered to the cylinder side of piston and cylinder assembly 46-1 and, at the same time, hydraulic fluid is drained from the rod end of piston and cylinder assembly 46-1 by line 61 through valve 62 and into a tank. When the piston in the piston and cylinder assembly 46-1 reaches the end of its stroke, the pressure in line 60 rises sharply. A branch line 60A directs the hydraulic fluid in line 60 to a pilot-pressure actuator 66. The sharply increased fluid pressure in line 60A energizes actuator 66 and thereby moves the spool in valve 67 whereby hydraulic pressure in line 65 is delivered to line 68. Line 68 is coupled to the cylinder ends of the piston and cylinder assemblies 46-2 and 46-3. At the same time, the rod ends of the piston and cylinder assemblies are coupled by a line 69 through valve 66 to the tank. When the pistons in piston and cylinder assemblies 46-2 and 46-3 reach the ends of their stroke, then the hydraulic fluid pressure in line 68 and branch line 68A rises sharply. The sharply increased fluid pressure in branch line 68A energizes the spool of valve 72. Pressurized hydraulic fluid is delivered from line 65 through valve 72 to a line 73 which is coupled to the cylinder ends of piston and cylinder assemblies 46-4 and 46-5. The hydraulic fluid, displaced by movement of the pistons, is returned to the tank from piston and cylinder assemblies 46-4 and 46-5 by a line 74 which is coupled to the valve 72. In view of the foregoing, it will be readily apparent to those skilled in the art that the valve arrangement may be employed for any number of pairs of pistons and cylinder assemblies used to advance the ends of auger sections which are coupled together by a universal joint toward the mine face. The valve arrangement is such that when a predetermined increased hydraulic pressure is developed in the lines delivering hydraulic fluid to the power side, i.e., the cylinder side and/or the rod side of a piston and cylinder assembly, then this increased pressure is used as a pilot-pressure for energizing an actuator used to control the position of a hydraulic control valve for the next pair of piston and cylinder assemblies. To sequentially retract the pistons into the cylinders of the piston and cylinder assemblies 46-1, 46-2, 46-3, 46-4 and 46-5, valve 64 is first actuated. This shifts the spool in valve 62 to a position where hydraulic fluid is delivered from line 65 to line 61. Fluid is drained from the cylinder side of the piston and cylinder assembly by line 60 through valve 62 to the tank. When the piston in piston and cylinder assembly 46-1 reaches the end of its stroke, the sharply increased pressure in line 61 is applied by a branch line 61A to energize a pilot-pressure actuator 75. The same mode of operation occurs sequentially thereafter in regard to pilot-pressure actuator 76 when energized by an increased pressure in branch line 69A. Such a sequential operation of control valves has the distinct advantage of minimizing the number of hydraulic lines that must extend along the longwall mine face to achieve a sequential energization of pairs of hydraulic cylinders.

Figure 6:
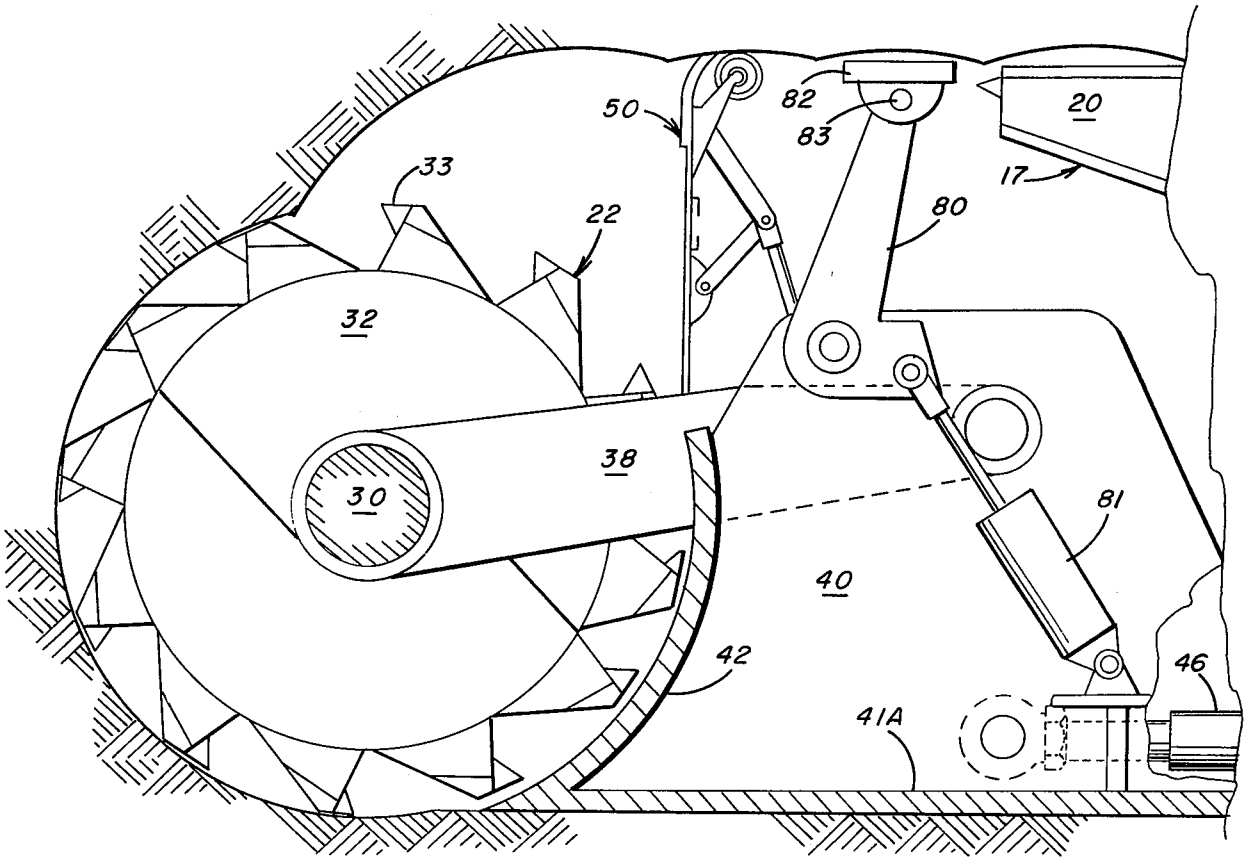
FIG. 6 is a sectional view similar to FIG. 4 but illustrating a modification of the auger assembly.

FIG. 6 illustrates a still further modification of the present invention wherein it is to be understood that the same reference numerals identify the same parts already described in regard to FIGS. 1–4. In view of this, it is deemed unnecessary to specifically describe these parts since the description given heretofore applies with equal effect. The embodiment of FIG. 6 provides additional support members which are needed when it is desired to rotate the articulated auger assembly for down-cutting, i.e., in the opposite direction to that shown in FIG. 4.

When the articulated auger assembly is rotated for the down-cutting mode of operation then, of course, the cutting elements 33 are angularly arranged to project from the outer peripheral edge surface of the auger sections so that the working surfaces of the cutting elements are displaced downwardly along the longwall mine face toward the floor of the mine. When the articulated auger assembly is rotated in this direction, reaction forces to the cutting forces are imposed on the scavenger plow sections. The scavenger plow sections are provided with means to maintain them in contact with the mine floor. This is because the reaction forces tend to lift the scavenger plow sections from the mine floor. As shown in FIG. 6, the additional means employed for this purpose includes a bell crank 80 pivotally mounted as far forward as possible onto the upper portion of each of the two or more vertically extending gussets 43 forming part of each scavenger plow section. The bell cranks are mounted so as to maximize the couple arm from the pivot to the rear toe of the floor plate. The bell crank 80 is coupled at its one end to the rod end of a piston and cylinder assembly which is, in turn, supported by the scavenger plow sections. As shown in FIG. 6, the bell crank 80 is mounted to extend at a slight upward angle to the rear of the longwall face to permit sliding movement along the roof. More specifically, the piston and cylinder assembly 81 is supported by a clevis mounting plate that is welded or otherwise secured to the side wall of a gusset plate 43 at a location which is adjacent the floor plate 41A. The upper end of bell crank 80 is connected to a sliding shoe 82 by a pivot pin 83. The sliding shoe can thus pivot upon the end of bell crank 80 to accommodate irregularities in the mine roof. As noted previously, the principal purpose of the bell crank 80, as well as the sliding shoe 82 and piston and cylinder assembly 81, is to maintain the scavenger plow sections in a fixed desired position upon the mine floor during the time of the sumping operation and during the time the articulated auger sections are sequentially moved upwardly to release coal from the longwall mine face. The piston and cylinder assemblies 81 are operated to separate the sliding shoe 82 from the mine roof.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. A variable wall mining machine to release coal from a longwall mine face, comprising:

a plurality of side-cutting auger sections to release and convey coal along a mine face, universal coupling means joining said auger sections together in an end-to-end relation to form an articulated auger assembly for extending along the longwall mine face, drive means coupled to at least one auger section to rotate said articulated auger assembly, actuator means for individual ones of said plurality of side-cutting auger sections to sump and shear cut the mine face, sequentially operative control means for said actuator means to advance the cutting auger sections sequentially into sumping cuts in the mine face, and scavenger plow means spaced outwardly in a partially surrounding relation with said articulated auger assembly at the side thereof opposite the mine face to facilitate transportation of released material by the cutting auger across the mine face.

2. The variable wall mining machine according to claim 1 wherein each of said plurality of side-cutting auger sections includes a drive shaft having an auger with cutting elements spaced about the edge thereof to release coal from the mine face.

3. The variable wall mining machine according to claim 1 further comprising bearing means journaled on individual ones of said plurality of side-cutting auger sections for joining to said actuator means therefor.

4. The variable wall mining machine according to claim 3 further comprising a support arm having one end connected to said bearing means while the opposite end of the support arm is supported for pivotal movement by said scavenger plow means.

5. The variable wall mining machine according to claim 1 wherein said scavenger plow means is further defined to include a plurality of elongated support frames joined together by pivot members in an end-to-end relation to form an articulated scavenger plow assembly.

6. The variable wall mining machine according to claim 5 wherein each of said plurality of elongated support frames further includes a shoe support plate to engage the floor at the longwall mine face.

7. The variable wall mining machine according to claim 6 further comprising support means carried by said elongated support frames to engage the roof at the longwall mine face.

8. The variable wall mining machine according to claim 7 wherein said support means includes an arm pivotally supported by said elongated support frames, and a fluid actuator coupled to said arm to displace said arm into and out of contact with the roof at the longwall mine face.

9. The variable wall mining machine according to claim 8 wherein said support means further includes a support plate having a face surface angularly positioned while supported by said arm.

10. The variable wall mining machine according to claim 6 wherein each of said plurality of elongated support frames further includes a guide plate extending upwardly from said shoe support plate in an outwardly spaced, arcuate manner from said articulated auger assembly to retain coal released thereby from the longwall mine face within open spaces in said articulated auger assembly for transportation thereby along the longwall mine face.

11. The variable wall mining machine according to claim 6 wherein said plurality of elongated support frames further includes means to engage the roof of the longwall mine face for rigid support of said elongated support frames between the roof and floor of the mine to counteract forces developed during cutting of the mine face.

12. The variable wall mining machine according to claim 5 further comprising bearing means journaled on individual ones of said plurality of side-cutting auger sections, and a support arm having one end connected to said bearing means while the opposite end of the support arm is supported for pivotal movement by one of said plurality of elongated support frames.

13. The variable wall mining machine according to claim 12 wherein said actuator means includes a first hydraulic actuator supported by each of said plurality of elongated support frames, and a support arm including a bearing at one end for rotatably supporting each of said side-cutting auger sections, said support arm being pivotally supported by one of said elongated support frames and coupled to said first hydraulic actuator for shear cut displacements of the side-cutting auger section.

14. The variable wall mining machine according to claim 13 wherein said actuator means further includes a second hydraulic actuator coupled to each of said plurality of support frames for sumping cut displacements of the side-cutting auger section coupled thereto by said support arm, and support means for said second hydraulic actuator means.

15. The variable wall mining machine according to claim 14 wherein said sequentially operative control means energizes said second hydraulic actuator for each adjacent end of two auger sections in said auger assembly for successive pump cuts in the longwall mine face.

16. The variable wall mining machine according to claim 15 wherein said sequentially operative control means energizes said first hydraulic actuator for each adjacent end of two auger sections in said auger assembly for successive shear cuts in the longwall mine face.

17. The variable wall mining machine according to claim 1 wherein said sequentially operative control means energizes said actuator means to sump cut two adjoining auger sections of said articulated auger assembly.

18. The variable wall mining machine according to claim 1 further comprising shield means supported by said scavenger plow means to extend vertically toward the roof of the longwall mine face.

19. The variable wall mining machine according to claim 18 further comprising pivotal support means coupled to said shield means for retracting the same.

* * * * *